US006079954A

United States Patent [19]

Kownacki et al.

[11] Patent Number: 6,079,954

[45] Date of Patent: Jun. 27, 2000

[54] AIR PUMPING STATION FOR PNEUMATIC TOY VEHICLE

[75] Inventors: Charles D. Kownacki, Erie, Pa.; Jeffrey G. Rehkemper, Chicago, Ill.; Ronnen Harary, Toronto, Canada

[73] Assignee: SpinMaster Toys Ltd., Toronto, Canada

[21] Appl. No.: 09/239,484

[22] Filed: Jan. 28, 1999

Related U.S. Application Data

[60] Provisional application No. 60/081,024, Apr. 9, 1998.

[51] Int. Cl.[7] ..... A63H 27/26; F04B 43/035

[52] U.S. Cl. ..... 417/63; 417/469; 417/440; 417/307; 446/212

[58] Field of Search ..... 417/63, 469, 440, 417/572, 307; 446/34, 220, 429, 63, 212

[56] References Cited

U.S. PATENT DOCUMENTS

| | | | |
|---|---|---|---|
| 872,043 | 2/1907 | Beck et al. | 417/63 |
| 1,390,559 | 9/1921 | Huntley | 417/63 |
| 1,425,614 | 8/1922 | Stickel | 417/63 |
| 2,733,699 | 2/1956 | Krinsky | 446/212 |
| 3,962,818 | 6/1976 | Pippin, Jr. | 46/74 D |
| 4,076,006 | 2/1978 | Breslow et al. | 124/64 |
| 4,223,472 | 9/1980 | Fekete et al. | 446/192 |
| 4,897,065 | 1/1990 | Fertig et al. | 446/63 |
| 5,188,557 | 2/1993 | Brown | 446/212 |
| 5,415,153 | 5/1995 | Johnson et al. | 124/63 |
| 5,779,457 | 7/1998 | Chuang et al. | 417/467 |
| 5,839,940 | 11/1998 | Ensmenger | 446/212 |

*Primary Examiner*—Charles G. Freay
*Assistant Examiner*—Robert Z. Evora
*Attorney, Agent, or Firm*—M. K. Silverman

[57] ABSTRACT

An air pumping station for a pneumatic toy vehicle powered by a re-fillable compressed air bottle or canister includes a stabilizing base having a flat ground engaging horizontal lateral bottom including a horizontal projecting geometry proportioned for placement under the feet of the user. The station also includes a fluid-tight vertical cylindrical housing. The station includes a reciprocating piston having a first end in fluid tight relation to interior walls of the housing and a second end defining hand-grippable pumping handles. The station has an air intake valve for the cylindrical housing. The pumping station includes an element for selectable clamping and unclamping of the toy vehicle to at least a first surface of the cylinder, however offset therefrom by a sufficient distance to avoid the reciprocal movement of the piston and grippable pumping handles. The cylinder includes an air exhaust aperture in fluid communication with the base of the cylinder. An air exhaust conduit is provided having a proximal end in fluid communication with the air exhaust aperture and a distal end including an air inlet valve defining a compressed air input to the air bottle of the toy vehicle. The grippable pumping handle and the stabilizing base exhibit elongate substantially co-parallel lateral horizontal axis which, in combination, define a virtual plane which avoids intersection of the toy secured to the cylindrical housing though the selectable clamping elements.

3 Claims, 6 Drawing Sheets

AIR PUMPING STATION FOR PNEUMATIC TOY VEHICLE

REFERENCE TO RELATED APPLICATION

This application corresponds in subject matter to Provisional Patent Application No. 60/081,024, filed Apr. 9, 1998.

BACKGROUND OF THE INVENTION

Pneumatic or air powered vehicles including, without limitation, toy or model air planes are known in the art. Essentially all such vehicles depend, for their power source, upon one form or another of a compressed air bottle or canister which, for purposes of re-filling, requires that the user, who is typically a pre-adolescent child, attach a pump of some kind to an intake valve of the vehicle and then reciprocate a handle of the pump while maintaining the base of the pump stable relative to the ground or floor to both efficiently effect the pumping function and to preclude potential damage to the vehicle. Certain toy or model vehicles, such as model airplanes are, due to their front and rear wing structure, particularly vulnerable to damage during the pumping function particularly when that function is performed by a child having limited coordination.

A further problem associated with the pumping or re-compression of the air bottle or canister associated with a pneumatic toy vehicle is that of overfilling or over-pressurization. In the prior art, this problem is manifested by the absence of an air gauge with pneumatic toy vehicles. A consequence thereof is often the over-pressurization of the air canister thereby creating a possibility of rupture thereof or damage of the entire pneumatic toy vehicle because the internal pressure of the air bottle has exceeded the design parameters of the system. The present invention thereby responds to the long-felt need which has existed in the art for an air pumping station for a pneumatic toy vehicle capable of controlling the physical relationship of the toy vehicle to the pump during the pumping function, providing a more stable pump suitable for use by pre-adolescent users, and providing air pressure status to the user to preclude over-pressurization of the system and air canister.

SUMMARY OF THE INVENTION

This invention provides for an air pumping station for a pneumatic toy vehicle powered by a re-fillable compressed air bottle or canister. The pumping station more particularly includes a stabilizing base having a flat ground engaging horizontal lateral bottom including a horizontal projecting geometry proportioned for placement under the feet of the user. The station also includes a fluid-tight vertical cylindrical housing secured, at a lower end thereof, to said stabilizing base. The station further includes a piston having a first end in fluid tight relation to interior walls of said housing and having a second end defining hand-grippable pumping means, said piston defining means for reciprocal movement relative to said cylindrical housing. Also included is an air intake valve for the cylindrical housing. The pumping station also includes means for selectable clamping and unclamping of said toy vehicle, inclusive of said compressed air bottle therein, to at least a first surface of said cylinder, however offset therefrom by a sufficient distance to avoid said reciprocal movement of said piston and grippable pumping means thereof. Said cylinder includes an air exhaust aperture in fluid communication with the base of said cylinder. An air exhaust conduit is provided having a proximal end in fluid communication with said air exhaust aperture and having a distal end including an air inlet valve defining a compressed air input to said air bottle of the toy vehicle. Said grippable pumping means and said stabilizing base exhibit elongate substantially co-parallel lateral horizontal axes which, in combination, define a virtual plane which avoids intersection of said toy vehicle when the same is secured to said cylindrical housing through said selectable clamping means.

It is accordingly an object of the invention to provide an air pumping station for the selectable re-filling or re-compression of a compressed air bottle associated with a toy or model vehicle such as a model airplane.

It is another object to provide an air pumping station of the above type by which the compressed air bottle of the toy or model vehicle may be re-compressed by a pre-adolescent user without risk of damage thereto.

It is a further object of the invention to provide an air pumping station of the above type in which the extent of re-compression of the vehicle air bottle may be monitored through the use of an externally visible air pressure gauge.

It is a yet further object of the invention to provide an air pumping station of the above type which will also serve as a means of upper body exercise to the user thereof.

The above and yet other objects and advantage of the present invention will become apparent from the hereafter set forth Brief Description of the Drawings, Detailed Description of the Invention and Claims appended herewith.

DETAILED DESCRIPTION OF THE INVENTION

Figure 1:
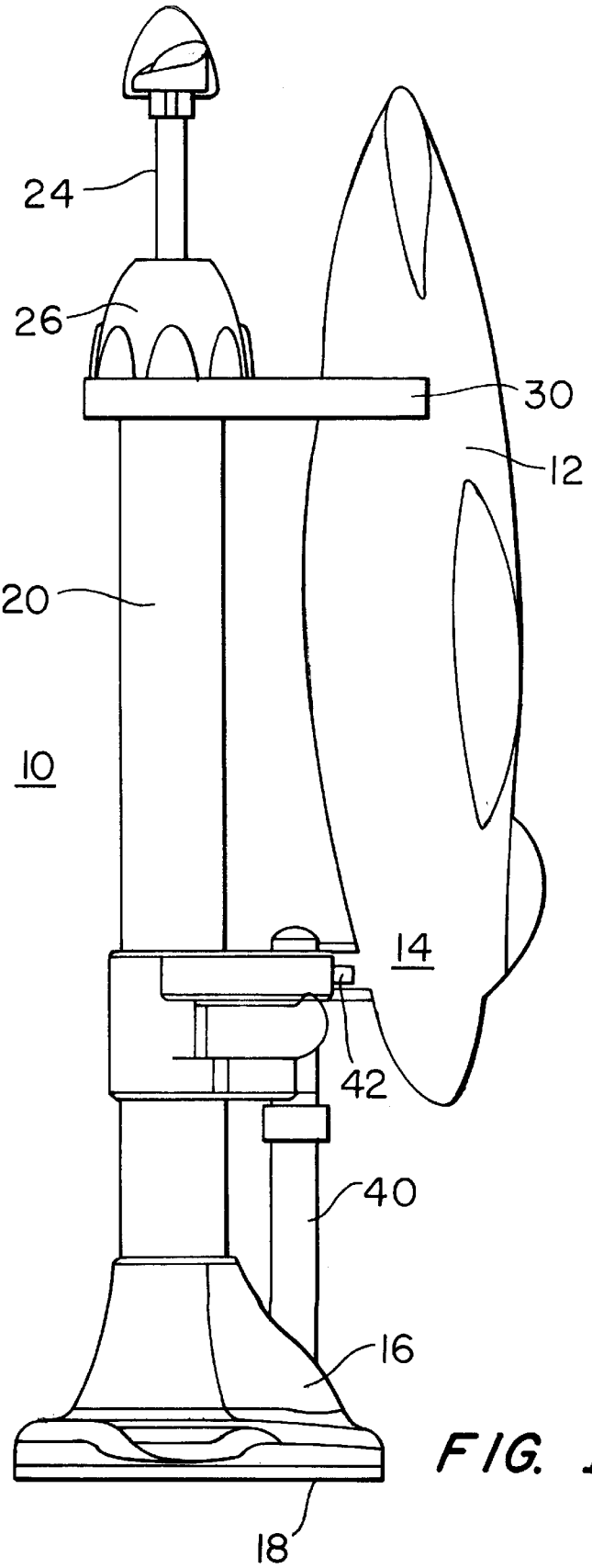
FIG. 1 is a side schematic view of the present invention showing, in association therewith a model toy airplane positioned for re-compression of the air bottle thereof.

With reference to the perspective view of FIG. 1, the present air pumping station may be seen to include an air pump assembly 10 adapted for use with a toy or model vehicle such as a model aeroplane 12 which includes therein a re-fillable/re-usable compressed air bottle located within region 14 of the model aeroplane 12.

The air pump assembly 10 more particularly includes a stabilizing base 16 (see also FIG. 2) which includes a flat ground engaging horizontal bottom 18. As noted in FIG. 2, the stabilizing base includes horizontally outwardly projecting elements 19 which are proportioned for placement underneath the feet of a user of the pumping station.

Figure 4:
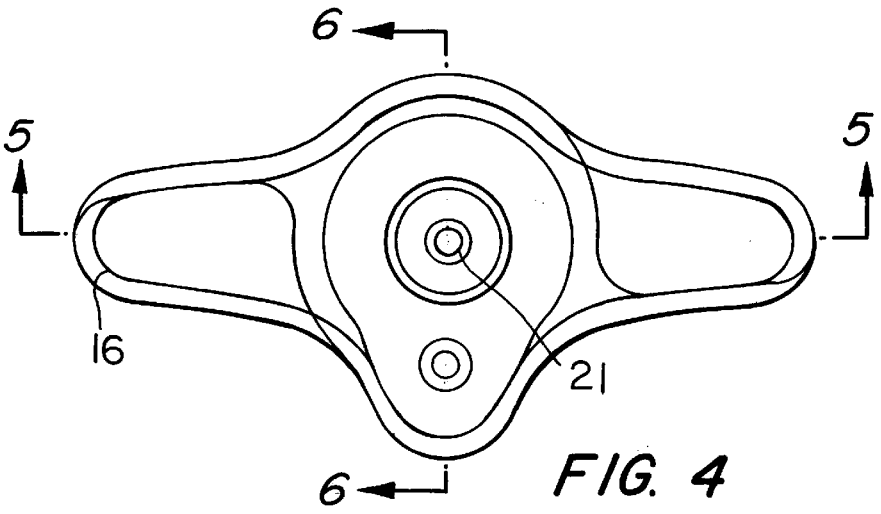
FIG. 4 is a top view of the base assembly of the inventive air pumping station, with the pumping means removed therefrom.
Figure 7:
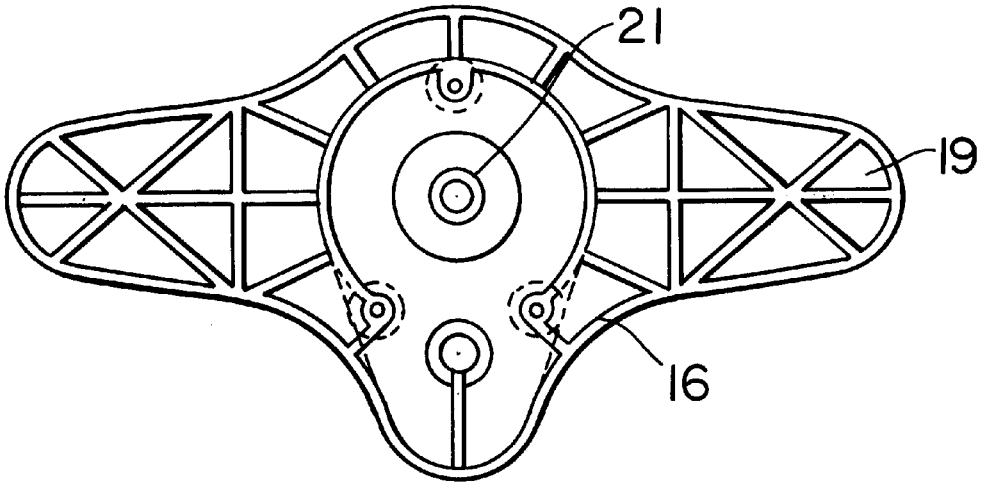
FIG. 7 is a bottom view of the air pump base bottom shown in FIG. 4.

The air pump assembly 10 further includes a fluid-tight vertical cylindrical housing 20 to which is secured said stabilizing base 16. Said base includes an external air inlet check valve 21 which is in fluid communication with the cylindrical housing 20. See FIGS. 4 and 7.

Figure 2:
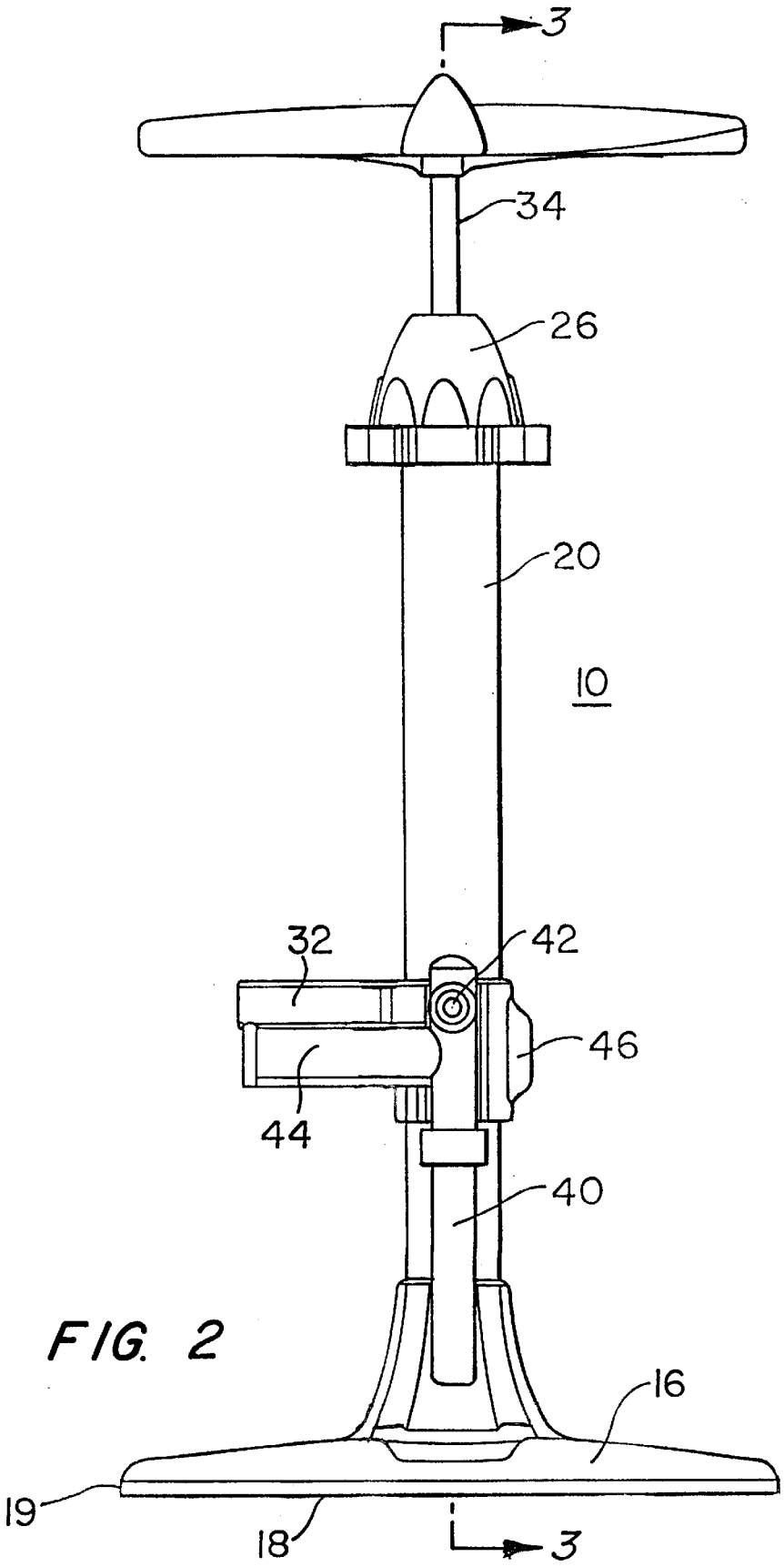
FIG. 2 is a right side view of FIG. 1 shown without the model aeroplane in position.
Figure 3:
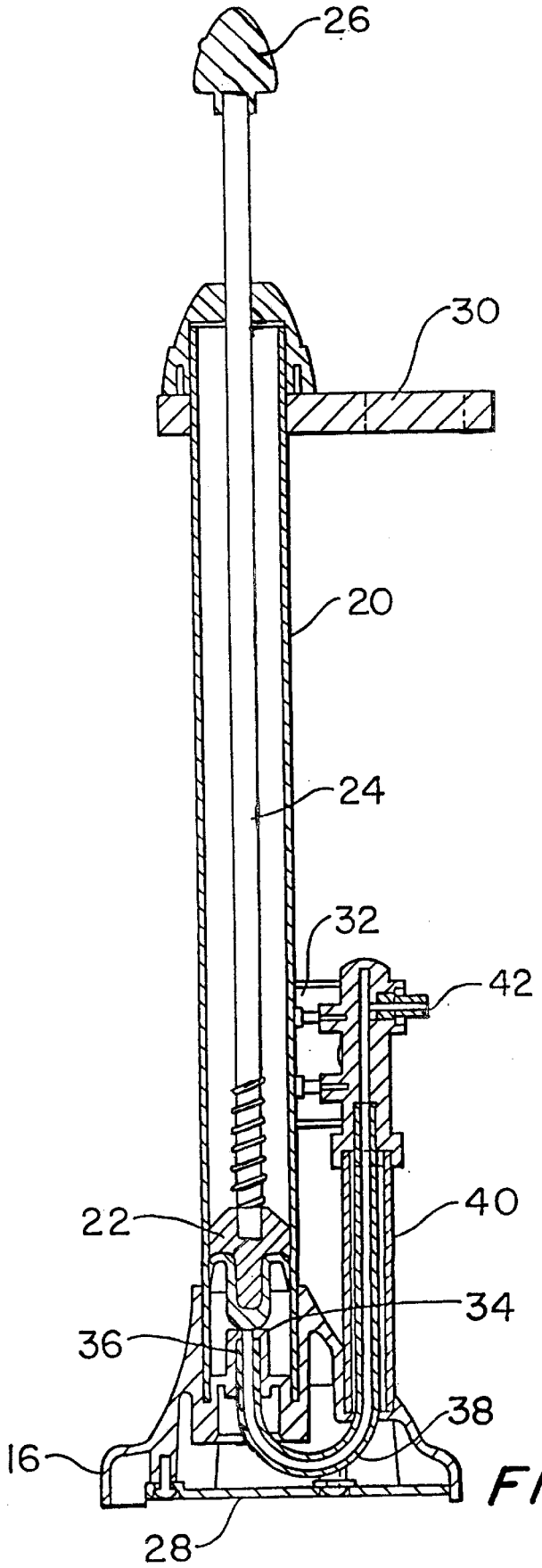
FIG. 3 is a vertical axial cross-sectional view taken along Line 3—3 of FIG. 2.

With reference to the vertical axial cross-sectional view of FIG. 3, said cylinder 20 may be seen to include piston means 22 which is situated in fluid-tight relationship to interior walls of said cylindrical housing 20. A rod element 24 thereof connects said piston means and to hand grippable pumping means 26 at an upper or opposite end thereof. As may be noted in FIG. 2, said pumping means 26 includes a laterally projecting horizontal geometry substantially similar to that of stabilizing base 16. As such, when the feet of the user are upon stabilizing base 16 and said pumping means 26 are engaged by the hands thereof, an anatomic stability will exist as the grippable pumping means 26 and, with it, connecting rod 24 and piston means 22 are reciprocated relative to said cylindrical housing 20. It is noted that housing 20 includes a top cap 26 necessary to maintain fluid integrity with housing 26.

Further shown in FIGS. 1 through 3 are means for selectably clamping and unclamping the model airplane 12 to the cylindrical housing 20. More particularly, there is, in FIGS. 1 and 3, shown an upper clamping means 30 which depends outwardly and integrally from cylindrical housing 20 and lower clamping means 32 which also depends outwardly from cylindrical housing 20. As may be noted, said clamping means 30 and 32 enable toy airplane 12 to be offset from the cylindrical housing 20 by a sufficient distance to avoid the reciprocating movement of the grippable pumping means 28 as the pumping station is used.

Figure 5:
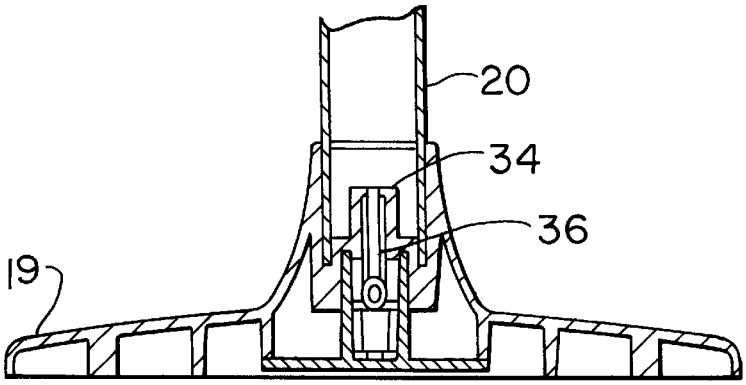
FIG. 5 is a cross-sectional view taken through Line 5—5 of FIG. 4.
Figure 6:
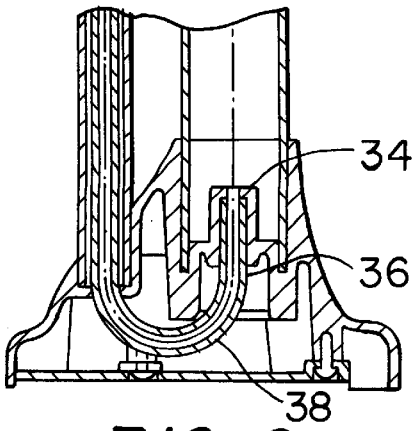
FIG. 6 is a cross-sectional view taken along Line 6—6 of FIG. 4.
Figure 8:
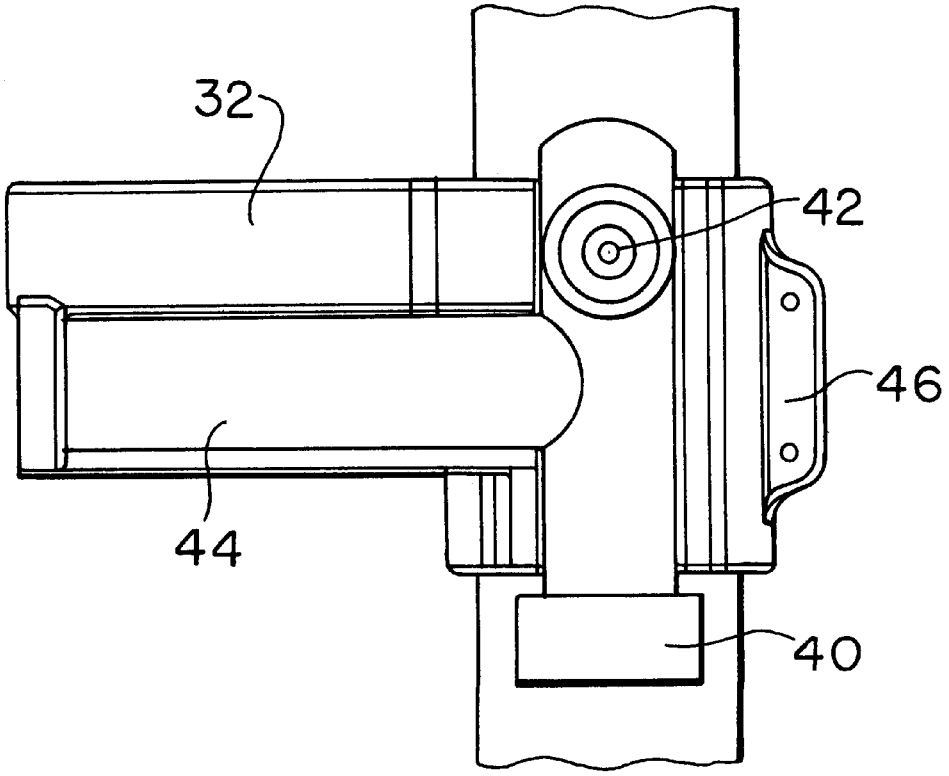
FIG. 8 is an enlarged external view of the air bottle air inlet valve and associated air pressure gauge.
Figure 9:
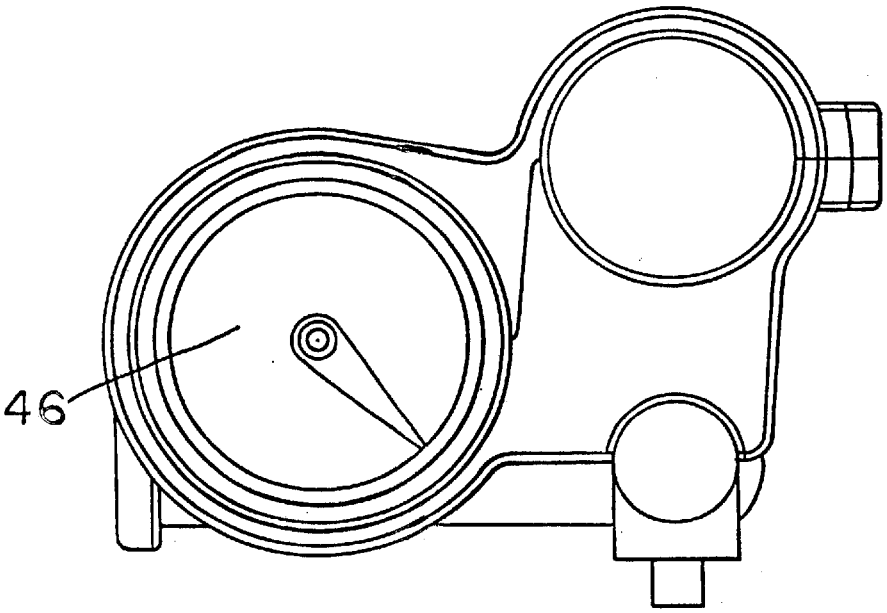
FIG. 9 is a right side plan view of FIG. 8.

Detailed views of the air exhaust assembly are shown in the views of FIGS. 3, 5 and 6. This includes an air exhaust aperture 34 which is in fluid communication with the base of cylindrical housing 20 located beneath piston means 22. Thereby, compressed air, resultant from the reciprocation of piston means 22, rod 24, and grippable pumping means 26, is forced into an air exhaust conduit 36 which is reinforced through the use of a concentric conduit 38, in the form of a flexible tubing and, therefrom, into a nozzle assembly 40. The nozzle assembly 40 includes an air exhaust aperture 42 which is at a distal end of inlet pressure valve 44 (see FIGS. 2, 8 and 10) which define the compressed air input to the compressed air bottle of the toy vehicle 12.

With reference to the views of FIGS. 2, 8, 9 and 10, the inlet pressure valve assembly may be seen to include an externally visible air pressure gauge 46, the function of which is to advise the user when the re-compression of the compressed air bottle has reached a satisfactory pressure.

Figure 10:
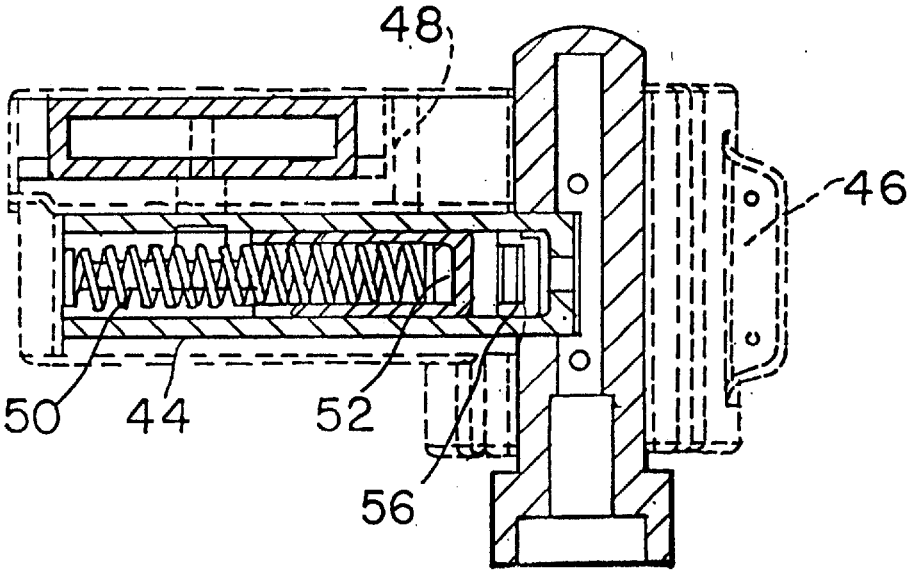
FIG. 10 is a longitudinal cross-sectional view of FIG. 8 showing therein the pressure relief valve of said air inlet valve.

As a further safety measure there is, as may be noted in FIG. 10, provided an air inlet relief valve 48 which will open in the event of the re-pressurization of the air bottle to a level which would be threatening to the structural integrity thereof. Further shown in FIG. 10 is spring 50 associated with the air inlet pressure relief valve, a travel gear 52, and a rubber stop 54. The air bottle is thereby protected from over pressurization both through gauge 46 and relief valve 48.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth herewith.

Having thus described our invention, what I claim as new, useful and non-obvious and, accordingly, secure by Letters Patent of the United States is:

1. An air pumping station for a pneumatic toy vehicle powered by a re-fillable compressed air bottle or canister, the pumping station comprising:

(a) a stabilizing base having a flat ground-engaging lateral bottom including projecting elements proportioned for placement under the feet of a user of the station;

(b) a fluid-tight longitudinal pump housing secured, at a distal end thereof, perpendicularly to said stabilizing base, said housing including an air intake valve;

(c) within said pump housing, piston means having a distal end in fluid tight relationship to interior walls of said housing and having a proximal end defining hand-grippable means for reciprocal movement of said piston means within said housing, said hand-grippable means having a lateral projecting dimension approximately equal to that of said projecting elements of said lateral bottom of said base, in which each of said dimensions comprises about one-half of an axial length of said pump housing;

(d) an air exhaust conduit having a proximal end in fluid communication with an exhaust aperture of said housing and having a distal end comprising an air inlet valve defining a compressed air input to said air bottle of the toy vehicle; and (e) means for selectable clamping and unclamping of said toy vehicle, inclusive of compressed air bottle within said vehicle, to a surface of said housing, said clamping means offset from said housing by a sufficient distant to avoid said reciprocal movement of said piston means when use is made of the station by a user.

2. The air pumping station as recited in claim 1 further comprising means for limiting the extent of re-compression of said compressed air bottle.

3. The air pumping station as recited in claim 2 comprising an externally visible air pressure gauge for use in monitoring the extent of re-compression of the vehicle air bottle.

* * * * *